United States Patent [19]

Sakai et al.

[11] Patent Number: 4,546,020

[45] Date of Patent: Oct. 8, 1985

[54] ARTIFICIAL FUR WITH GUARD HAIR FIBERS AND UNDER FUR FIBERS

[75] Inventors: Masaaki Sakai; Kenji Sato; Seiichi Yamagata, all of Otsu, Japan

[73] Assignee: Toray Industries, Inc., Tokyo, Japan

[21] Appl. No.: 656,512

[22] Filed: Oct. 1, 1984

[51] Int. Cl.[4] ..... A01N 1/00

[52] U.S. Cl. ..... 428/16; 428/89; 428/92

[58] Field of Search ..... 428/16, 89, 92

[56] References Cited

U.S. PATENT DOCUMENTS

| | | | |
|---|---|---|---|
| 1,548,819 | 8/1925 | Blumenthal | 428/89 |
| 2,815,558 | 12/1957 | Bartovics et al. | 428/89 |
| 4,415,611 | 11/1983 | Yamagata et al. | 428/16 |
| 4,461,791 | 7/1984 | Matsui et al. | 428/16 |

*Primary Examiner*—Marion E. McCamish
*Attorney, Agent, or Firm*—Austin R. Miller

[57] ABSTRACT

An artificial fur composed of a warp pile fabric comprising a ground construction and pile yarns fixed to the ground construction and present in the form of fiber bundles within the ground construction. The pile yarns are composed of guard hair fibers and under fur fibers, the constituent fibers in the pile portion being opened and raised and the guard hair fibers of the pile yarns having the top ends thereof tapered. Plural kinds of pile yarns differing in at least one of the fineness, color, thickness, and length of fiber are used and a stripe pattern is manifested on the pile surface by arranging the alignment and/or density of the pile yarns appropriately.

4 Claims, 2 Drawing Figures

ARTIFICIAL FUR WITH GUARD HAIR FIBERS AND UNDER FUR FIBERS

BACKGROUND OF THE INVENTION

1. Field of the Invention

The present invention relates to an artificial fur. More particularly, the present invention relates to an artificial fur which is highly improved in the appearance and touch of rising hairs.

2. Description of the Prior Art

Genuine furs such as mink, fox, raccoon, and sable are considered high-grade materials for the production of fashion garments because of their excellent appearance, luster, and touch. Various technical researches and proposals have heretofore been made with a view to developing artificial furs having properties similar to those of genuine furs. Relatively advanced new techniques concerning artificial furs are disclosed, for example, in Japanese Unexamined Patent Publication (Kokai) Nos. 49-116370, 55-137244, and 56-58067. Even according to these techniques, however, it is very difficult to duplicate the excellent appearance and touch of genuine furs, and no satisfactory results have been obtained.

The inventors have made some effective proposals. For example, they proposed in U.S. Pat. No. 4,415,611 an artificial fur having a structure in which "under fur" and "guard hairs" are formed by pile fibers fixed tightly to a ground construction and the top end portions of the guard hairs are gradually tapered, and a method for producing this fur from a pile cloth. In this artificial fur, a plurality of "guard hair fibers" and a plurality of "under fur fibers" are gathered at the roots thereof in the form of yarns. These roots are integrally connected to the ground construction. According to the technique proposed in this U.S. patent, however, pile fiber bundles having the tops separated from one another and comprising of "guard hair fibers" and "under fur fibers" are formed from pile yarns of the pile cloth. For this purpose, fibers not tightly held on the ground construction should be separated and removed by a raising operation. Accordingly, the ratio of utilization of the material cloth is low, and there is a risk of damage of pile fibers.

The inventors further researched the subject and found a method in which slippage removal of fibers constituting pile yarns is utilized, as disclosed in U.S. patent application Ser. No. 395,010. According to this method, the inventors succeeded in solving the problems of reduction of the ratio of utilization of fibers and damage of fibers, which are involved in the technique of U.S. Pat. No. 4,415,611. The fundamental idea of this method is to prepare an artificial fur by applying tension on pile yarns having a first group of fibers to be formed into guard hairs and a second group of shorter fibers to be formed into under fur, along the length of the pile yarns, to cause a slipping phenomenon among the pile yarn-constituting fibers without substantial breakage of the first group of fibers to be formed into guard hairs and to break the continuity of the pile yarns, whereby a pile cloth as the material for the manufacture of an artificial fur, which comprises a number of pile fiber bundles having root portions tightly held to the ground construction in the form of gathered yarn-like bundles and top end portions separated from one another, is prepared; subjecting the pile cloth to a brushing action to remove free fibers having root portions not tightly held to the ground construction and being mingled in the pile fiber bundles and to simultaneously open the top end portions of the fibers constituting the respective pile fiber bundles; and, if necessary, backing the ground construction with an adhesive such as a synthetic resin to ensure holding of the pile fibers by the ground construction.

In the artificial fur prepared according to this method, the first group of fibers to be formed into guard hairs have a larger fineness and a longer fiber length than the second group of fibers to be formed into under fur, and the top end portions of the first group of fibers are gradually thinned and sharpened. Accordingly, this artificial fur has an appearance and touch quite similar to those of a genuine fur. However, since the first and second groups of fibers constituting the pile yarns of the material pile fabric are homogeneous throughout the pile fabric, the appearance of the product fur is monotonous, and the product fur has an inferior aesthetic effect compared to genuine furs.

The inventors further researched this and found that if plural kinds of yarns differing in the properties are used as material pile yarns in preparing the above-mentioned material pile cloth, groups of pile fiber bundles differing in the properties are locally produced in the pile cloth and the aesthetic value of the appearance is enhanced.

SUMMARY OF THE INVENTION

The fundamental technical idea of the present invention is to provide an artificial fur having an appearance or touch closer to the appearance or touch of a genuine fur by improving the artificial fur prepared according to the method disclosed in the above-mentioned U.S. patent application Ser. No. 395,010, especially an artificial fur having an appearance resembling that of a high-grade genuine fur by increasing the rising hair density of guard hair fibers having the sharpened top ends and imparting a stripe pattern to the surface of rising hairs.

More specifically, in accordance with the fundamental aspect of the present invention, there is provided an artificial fur comprising a pile cloth having pile yarns composed of guard hair fibers and under fur fibers and fixed to a ground construction, wherein the pile yarns are present in the form of fiber bundles within the ground construction, the constituent individual fibers of the pile yarns are opened and raised in the pile portions, the guard hair fibers of the pile yarns have the tapered top ends and a stripe pattern is formed on the surface of the pile with the rising hair density of the guard hair fibers being at least 500 fibers per $cm^2$.

In the warp pile cloth to be used as the material of an artificial fur, the above-mentioned stripe pattern can be formed by using as material pile yarn plural kinds of yarns being different from each other in a construction of said yarn in such a way that at least one of a physical property of the constituent guard hair and/or under fur of one kind of yarn such as fiber length, fineness, color or ends number used in the yarn is different from that of another kind of yarn and arranging each kind of pile yarns in a specific pattern having a certain width or certain pile yarn density respectively. The difference of the structure in the pile yarns can be produced by the difference of the color in the guard hair fibers, the difference of the rising length of the guard hair fibers, the difference of the apparent fineness or denier in the guard hair fibers, the difference of the rising hair density in the guard hair fibers, the difference of the color in the under fur fibers, the difference of the rising hair density in the under fur fibers, and the difference of the apparent fineness or denier in the under fur fibers.

DESCRIPTION OF THE PREFERRED EMBODIMENTS

Figure 1:
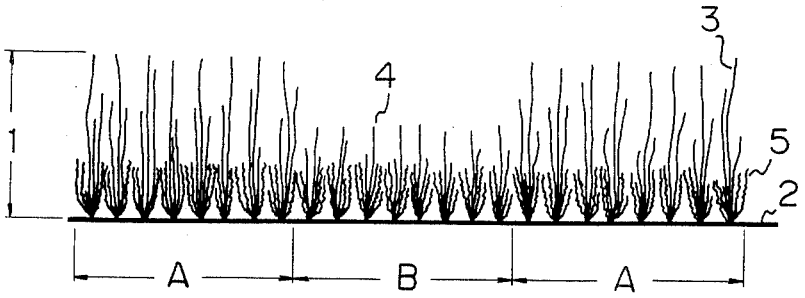
FIGS. 1 and 2 are sectional model diagrams illustrating an artificial fur according to the present invention.

The artificial fur of the present invention comprises a ground construction and rising fibers rising densely from the ground construction. This artificial fur is obtained preferably by using a single or double pile weaving machine customarily adopted in the art. Especially, a method for preparing a warp pile cloth as the material of an artificial fur, disclosed in the above-mentioned U.S. patent application Ser. No. 395,010, is adopted in the present invention.

In a fast pile construction, having a warp pile density of less than 50 piles per inch according to a preferred embodiment of the above-mentioned basic technique, the upper limit of the pile yarn density is about 500 yarns per square inch, and when a mixed spun yarn having a yarn count of 10 S and including 40% of guard hair fibers having a fineness of 40 d are used as pile yarns for formation of a pile cloth, the rising hair density of the guard hair fibers is about 500 fibers per $cm^2$. On the other hand, in order to obtain such a high rising hair density of the guard hair fibers as at least 500 fibers per $cm^2$ in the present invention, it is necessary to use fine warp ground yarns and pile yarns composed of mixed spun yarn having a yarn count of at least 10 S and including about 40% of guard hair fibers having a fineness of about 40 d and to weave these yarns at a warp density of at least 60 yarns per inch.

It is preferred that weaving is effected at a warp density of at least 70 ends per inch, whereby a rising hair density of at least 800 fibers/$cm^2$ can be obtained.

Studies by the inventors showed that a pile fabric having at least a 100 root portion per $cm^2$ as a rising hair root portion density is preferable for a high grade artificial fur and that the artificial fur of the present invention woven by the above high density usually has at least a 200 root portion per $cm^2$ and is extremely high grade in appearance and feeling.

FIG. 1 is a sectional model view illustrating diagrammatically an artificial fur of the present invention in which a stripe pattern is manifested by the difference of the rising hair length in guard hair fibers rising from the ground construction.

In FIG. 1, the rising hair portion 1 comprises guard hair fibers 3 and 4 and under fur fibers 5, and root portions of these fibers are secured to the ground construction 2. This fixation is accomplished by a weave texture or a backing material. In the rising hair portion 1, the pile fibers are opened, and the guard hair fibers 3 and 4 have a rising length larger than that of the under fur fibers and the guard hair fibers 3 and 4 have the tapered end portions and are relatively linear. In the root portions, the pile yarns have a configuration like a fiber bundle having twist and are fixed by the ground construction 2.

The rising hair portion 1 comprises at least two kinds of pile fibers. The guard hair fibers of the rising hair portion 1 rising from the part A of the ground construction have a rising hair length longer than the guard hair fibers of the rising portion 1 rising from the part B of the ground construction. The rising hair length of the under fur fibers 5 may be the same as that of the rising hair portion rising from part A or B of the ground construction.

The width of stripes which can be recognized as the difference between both the stripes of part A composed of the guard hair fibers having a relatively long rising hair length and part B composed of the guard hair fibers having a relatively short rising hair length differs according to the rising hair density of the pile yarns, but recognition of stripes is possible if at least 10 root portions are successively arranged in each part A and B which is provided in the pile fabric, alternately. Generally, in order to manifest definite stripes on the surface of rising hairs, it is preferred that parts A and B are arranged alternately with a width of at least 20 mm.

Figure 2:
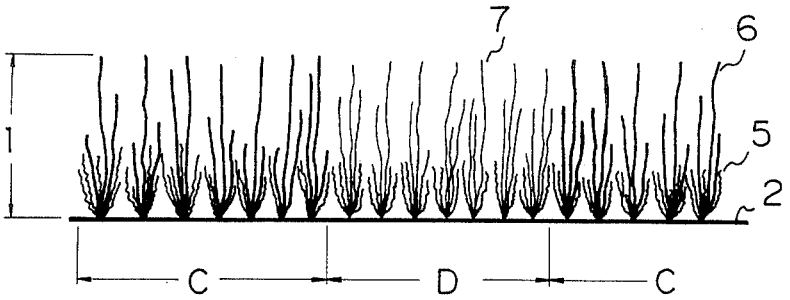

FIG. 2 is a sectional model view illustrating diagrammatically an artificial fur of the present invention in which a stripe pattern is manifested by the difference in the fineness of the rising hair density in the guard hair fibers rising from the ground construction. In FIG. 2, the rising hair portion 1 comprising guard hair fibers 6 and 7 and under fur fibers 5, and root portions of these fibers are secured in the ground construction 2. The pile fibers are opened in the rising hair portion. The guard hair fibers 6 and 7 have a rising hair length longer than the under fur fibers 5, and they have tapered top ends and are relatively linear. In the root portions, the pile yarns have a configuration like a fiber bundle with twist and are fixed by the ground construction 2.

The rising hair portion 1 comprises at least 2 kinds of pile fibers. The guard hair fibers of the rising hair portion 1 rising from part C of the ground construction have a fineness thicker than that of the guard hair fibers of the rising hair portion 1 rising from part D of the ground construction. The fineness of the under fur fibers 5 may be the same as the fineness of the rising hair portion rising from part C or D of the ground construction, or the fineness of the under fur fibers 5 rising from part D may be thinner than the same rising from part C.

The width of stripes which can be recognized as the difference between both stripes of part C composed of the guard hair fibers having a relatively large thickness and part D composed of the guard hair fibers having a relatively fine thickness differs according to the rising hair density of the pile yarns, but recognition of stripes is possible if at least 10 root portions were successively arranged in each part C and D which is provided in the pile fabric, alternately. In order to manifest definite stripes on the surface of rising hairs, it is generally preferred that parts C and D are arranged alternately with a width of at least 20 mm.

The stripe pattern manifested by the difference of the rising hair length in the guard hair fibers and the stripe pattern manifested by the difference of the fineness in the guard hair fibers have been described hereinbefore, but according to similar methods, there can be manifested a stripe pattern by the difference of the apparent thickness of the guard hair fibers, a stripe pattern by the difference of the color in the guard hair fibers, a stripe pattern by the difference of the color in the under fur fibers, (such color differences may be realized by using colored yarns), a stripe pattern by the difference of the rising hair density in the guard hair fibers, and a stripe pattern by the difference of the rising hair density in the under fur fibers.

Furthermore, a more definite stripe pattern can be obtained by combining two or more of the foregoing stripe patterns appropriately. Of course, it is possible to obtain a wave patterned stripe construction having concave portions and convex portions.

EXAMPLE 1

A 150 d/72 f yarn having a twist number of 300 T/m (S), which was composed of island-in-sea type conjugated fibers (the island component was composed of polyethylene terephthalate, and the sea component was composed of polystyrene, the island/sea ratio was 55/45, and ultra-fine filaments of 0.1 d were formed by removal of the sea component) was used as either the ground warp or the ground weft. A blended spun yarn having a count of 10 S and a twist number of 452 T/m (Z) was prepared by mix-spinning 55% of polybutylene terephthalate staple fibers of 40 d×40 mm having both the ends tapered by an aqueous solution of an alkali and being package-dyed in a dense brown color as the guard hair fibers and 45% of polybutylene terephthalate staple fibers of 1.5d×20 mm (the crimp number was 15 crimps per inch and the crimp degree was 10%) package-dyed into a light brown color as the under fur fibers under a customary cotton spinning process. This spun yarn was untwisted by a twist number of 452 T/m (S) by a twisting machine for producing a fancy yarn. Simultaneously, a water-soluble PVA filament yarn was supplied at an overfeed rate of 0% to the substantially untwisted yarn of 10 S to double the substantially untwisted yarn with the PVA filament yarn. The resulting doubled yarn having an enhanced tenacity was used as the pile yarn A. A spun yarn was prepared by mix-spinning 35% of polybutylene terephthalate staple fibers of 40 d×30 mm having both the ends tapered and dyed in a dense brown color as the guard hair fibers and 65% of polybutylene terephthalate staple fibers of 1.5 d×20 mm (the crimp number was 15 crimps per inch and the crimp degree was 10%) as the under fur fibers, and the spun yarn was processed in the same manner as in case of the pile yarn A. The resulting yarn was used as the pile yarn B.

A total of 72 pile yarns A were arranged along a width of 2.5 cm, and 36 pile yarns A and 36 pile yarns B were arranged alternately one by one along a subsequent width of 2.5 cm, 72 pile yarn B were arranged along a subsequent width of 2.5 cm, and 36 pile yarns A and 36 pile yarns B were arranged alternately one by one along a subsequent length of 2.5 cm. The so-arranged pile yarns were warped by a sectional warping machine.

A pile cloth was prepared from the above-mentioned ground yarns and pile yarns by using a double velvet weaving machine according to the method disclosed in U.S. patent application Ser. No. 395,010 (Japanese Unexamined Pat. Publication No. 57-95342). The warp ground yarn density was 72 ends per inch, the warp pile yarn density was 72 ends per inch, and the weft ground yarn density was 45 ends per inch. The obtained cloth was a fast pile fabric in which the distance between the upper and lower base fabric was 45 mm, and the upper and lower base fabric were separated from each other.

The so-obtained pile fabric was backed with a polyurethane resin, and the pile yarns were opened and the brushing operation was carried out for removing free fibers. Then, the polystyrene constituting the sea portion of the ground yarn fibers was dissolved by trichloroethylene, and the pile surface was brushed to make the rising hairs uniform.

In the so-obtained artificial fur, portions where the guard hair fibers having a maximum rising hair length of about 40 mm and rising from the ground construction relatively densely, compose a dense brown colored stripe consisting of the guard hair fibers and portions where the guard hair fibers having a maximum rising hair length of about 30 mm and rising from the ground construction relatively roughly, compose a light brown colored stripe caused by color of the under fur fibers were arranged alternately along widths of 5 cm to manifest a stripe pattern on the surface of the rising hairs. The rising hair density of the guard hair fibers was as high as about 880 fibers per $cm^2$. When a woman's half-coat was prepared from the so-obtained artificial fur, the resulting half-coat had mink-like appearance and touch.

EXAMPLE 2

A 150 d/72 f yarn twisted at a twist number of 300 T/m (S), which was composed of island-in-sea type conjugated fibers (the island component was composed of polyethylene terephthalate, and the sea component was composed of polystyrene, the island/sea ratio was 55/45, and ultra-fine fibers of 0.1 d were formed by elimination of the sea component) was used as the ground warp, and a spun yarn of 40/2 S composed of staples of 2 d×51 mm, which were formed of island-in-sea type conjugated fibers (the island component was composed of polyethylene terephthalate, and the sea component was composed of polystyrene, the island-/sea ratio was 55/45, and ultrafine fibers of 0.1 d×11 islands were formed by elimination of the sea component), was used as the ground weft. A blended spun yarn having a count of 15 S and a twist number of 534 T/m (Z) was prepared by mix-spinning 55% of polybutylene terephthalate staple fibers of 40 d×40 mm having both ends tapered and being dyed in a dense grey color as the guard hair fibers and 45% of polybutylene terephthalate staple fibers of 1.5 d×20 mm (the crimp number was 15 crimps per inch and the crimp degree of 10%) dyed in a light grey color as the under fur fibers under a customary cotton spinning process. This spun yarn was untwisted by a twisting number of 534 T/m (S) by a twisting machine for producing a fancy yarn. Simultaneously, a water-soluble PVA filament yarn was supplied at an overfeed rate of 0% to double the substantially untwisted yarn of 10 S with the PVA filament yarn. The resulting yarn having an enhanced tenacity was used as the pile yarn A. A spun yarn was prepared by mix-spinning 35% of polybutylene terephthalate staple fibers of 25 d×30 mm having both ends tapered and being dyed in a dense grey color as the guard hair fibers and 65% of polyethylene terephthalate staple fibers of 1.5 d×20 mm (the crimp number was 15 crimps per inch and the crimp degree was 10%) dyed in a light grey color as the under fur fibers. The spun yarn was treated in the same manner as in case of the pile yarn A. The resulting yarn was used as the pile yarn B.

An artificial fur was prepared in the same manner as in Example 1 by using the above-mentioned ground yarns and pile yarns. Incidentally, the ground warp density was changed to 54 ends per inch.

The rising hair density of the guard hair fibers in either portion of the pile yarns A or portion of the pile yarn B was as high as about 970 fibers per $cm^2$ in the so-obtained artificial fur. Portions where the fibers in the pile yarn A compose a dense grey colored stripe caused by the color of the guard hair fibers and portions where the fibers in the pile yarn B compose a light colored stripe caused by the color of the under fur fibers were arranged alternately along widths of 5 cm to manifest a stripe pattern on the surface of the rising hairs. When a woman's half-coat was prepared by using this artificial fur, a coat having an appearance and touch resembling those of mink was obtained.

We claim:

1. In an artificial fur composed of a warp pile fabric comprising a ground construction and pile yarns fixed to the ground construction and present in the form of fiber bundles within the ground construction, said pile yarns being composed of guard hair fibers and under fur fibers, the constituent fibers in the pile portion being opened and raised and the guard hair fibers of the pile yarns having the top ends thereof tapered, and improvement wherein plural kinds of the fibers of pile yarns differing in at least one of the fineness, color, thickness, and length of fiber are used in at least guard hair fibers and a stripe pattern is manifested on the surface of the pile with the rising hair density of the guard hair fibers being at least 500 fibers per $cm^2$.

2. An improved artificial fur as set forth in claim 1, wherein plural kinds of yarns differing in the color of the guard hair fibers and/or the color of the under fur fibers are used as the pile yarns.

3. An improved artificial fur as set forth in claim 1, wherein plural kinds of yarns differing in the rising hair length of the guard hair fibers and/or the rising hair length of the under fur fibers are used as the pile yarns.

4. An improved artificial fur as set forth in claim 1, wherein the rising hair density of the guard hair fibers is 500 to 1500 fibers per $cm^2$ at the roots thereof.

* * * * *